US010502539B2

(12) United States Patent
Nill

(10) Patent No.: US 10,502,539 B2
(45) Date of Patent: Dec. 10, 2019

(54) SYSTEM AND METHOD FOR UNDERGROUND BLASTING

(71) Applicant: DETNET SOUTH AFRICA (PTY) LIMITED, Sandton (ZA)

(72) Inventor: Patrick Nill, Avon, CT (US)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 123 days.

(21) Appl. No.: 15/561,051

(22) PCT Filed: Mar. 22, 2016

(86) PCT No.: PCT/US2016/023549

§ 371 (c)(1),
(2) Date: Sep. 23, 2017

(87) PCT Pub. No.: WO2016/154184

PCT Pub. Date: Sep. 29, 2016

(65) Prior Publication Data

US 2018/0073845 A1 Mar. 15, 2018

Related U.S. Application Data

(60) Provisional application No. 62/136,936, filed on Mar. 23, 2015.

(51) Int. Cl.
*F42D 1/055* (2006.01)
*F42D 3/04* (2006.01)
(Continued)

(52) U.S. Cl.
CPC ..... *F42D 1/055* (2013.01); *E21D 9/006* (2013.01); *F42D 1/02* (2013.01); *F42D 3/04* (2013.01)

(58) Field of Classification Search
CPC ... E21D 9/006; F42D 1/02; F42D 1/04; F42D 1/043; F42D 1/055; F42D 1/06; F42D 3/04; F42D 5/04
(Continued)

(56) References Cited

U.S. PATENT DOCUMENTS 2,239,123 A * 4/1941 Stoneking ..... F42D 1/04 102/312
3,817,181 A * 6/1974 Persson ..... F42D 1/04 102/275.9
(Continued)

FOREIGN PATENT DOCUMENTS

CN 104111008 A 10/2014

OTHER PUBLICATIONS

English language machine translation of SK Engineering and Construction Co. Ltd., Chinese patent document CN104111008 A, published Oct. 22, 2014 (21 pages) (Year: 2014).*
(Continued)

*Primary Examiner* — David J Bagnell
*Assistant Examiner* — Michael A Goodwin
(74) *Attorney, Agent, or Firm* — Michael Best & Friedrich LLP

(57) ABSTRACT

A simplified blasting system enables utilization of electronic delay detonators (23*e*) and pyrotechnic delay detonators (23*p*) in a simplified blasting set up. Both the electronic time delay detonators (23*e*) and the pyrotechnic delay detonators (23*p*) have shock tube fuses (32) which enables both types of detonators to be initiated by a common trunkline such as a low energy detonating cord trunkline (38). This system eliminates the need for separate firing systems, an electric firing system for electrically-initiated electronic delay detonators and a detonating cord trunkline for the non-electrically-initiated pyrotechnic delay detonators.

8 Claims, 3 Drawing Sheets

(51) Int. Cl.
*E21D 9/00* (2006.01)
*F42D 1/02* (2006.01)

(58) Field of Classification Search
USPC ..... 102/311, 301, 312, 206, 217, 275.5, 102/275.6, 275.11
See application file for complete search history.

(56) References Cited

U.S. PATENT DOCUMENTS 4,037,538 A * 7/1977 Andrews ..... F42C 5/00 102/210
4,216,998 A 8/1980 Bowen et al.
4,406,226 A 9/1983 Davitt et al.
5,942,718 A * 8/1999 Falquete ..... F42D 1/045 102/202.5
6,006,671 A * 12/1999 Yunan ..... C06C 5/04 102/275.1
6,454,359 B1 9/2002 Kang
6,814,005 B1 11/2004 Vestre
7,188,566 B2 * 3/2007 Gladden ..... C06B 23/001 102/275.11
2008/0282925 A1 * 11/2008 Lownds ..... F42D 1/055 102/311
2012/0111216 A1 * 5/2012 Koekemoer ..... F42B 3/121 102/201

OTHER PUBLICATIONS

International Search Report and Written Opinion for Application No. PCT/2016/023549 dated Jun. 10, 2016 (7 pages).
John Kovacs, "Mine Development Optimisation—An Evolutionary Process," 12th AIMM Underground Operator's Conference, Adelaide South Australia, Australia, Mar. 24-26, 2014.

* cited by examiner

SYSTEM AND METHOD FOR UNDERGROUND BLASTING

CROSS-REFERENCE TO RELATED APPLICATION

This application claims priority of U.S. provisional patent application Ser. No. 62/136,936 filed on Mar. 23, 2015 in the name of Patrick Nill and entitled "System and Method For Underground Blasting".

BACKGROUND OF THE INVENTION

Field of the Invention

The present invention is concerned with an underground blasting system comprising a plurality of detonators, some or all of which are delay detonators, interconnected by one or more fuses, and a method of underground blasting using the system.

Description of Related Art

There is ample art concerning underground blasting of tunnels. Two randomly selected examples are as follows. U.S. Pat. No. 6,454,359 issued on Sep. 24, 2002 to Dae Woo Kang for "Method for Blasting Tunnels Using an Air Bladder" is very briefly discussed below. U.S. Pat. No. 4,216,998 issued on Aug. 12, 1980 to Ray J. Bowen et al. for "Method of Underground Mining by Pillar Extraction" shows a method of sublevel caving and pillar and top coal extraction for mining thick coal seams.

As is well known, the sequence of detonation of explosive charges in a given blast must be accurately timed, with delays between detonators measured in milliseconds. To this end, many if not all of the detonators in a blasting system are delay detonators which are characterized by containing an internal timing mechanism. The timing mechanism ("delay timer") provides a delay period between the time a detonation signal is received by the detonator and the detonator is detonated. Such delay detonators may comprise either pyrotechnic or electronic delay timers.

In blasting operations, particularly in tunnel roadway blasting and under-ground mining, typically a plurality of boreholes are drilled into a geological formation such as a rock formation, ore body or coal seam in a pattern which defines a tunnel. The pattern includes a plurality of perimeter boreholes positioned to define the walls of the tunnel and a plurality of interior boreholes positioned within the perimeter boreholes. Explosive charges are placed within the boreholes with one or more detonators emplaced within each of the explosive charges. For example, see FIGS. 1-2d and 4 of the aforesaid U.S. Pat. No. 6,454,359 and the description thereof starting at column 1, line 15, (FIGS. 1-2d) and at column 4, line 29 (FIG. 4).

The detonators of such blasting systems are interconnected by one or more fuses which are energized by a suitable blasting device to initiate a carefully timed sequence of explosions to blast a geological formation, such as a rock formation, ore body or coal seam. The rubble ("muck") resulting from the blast is then removed. The operation is repeated to continue advancing to a tunnel through the geological formation.

An article by John Kovacs entitled "*Mine Development Optimisation—An Evolutionary Process*" was published in connection with the 12$^{th}$ AUSIMM Underground Operator's Conference, Adelaide South Australia, Australia, 24-26 Mar. 2014. This article discloses at page 54 under the heading "Stage 3-perimeter holes initiated with electronic detonator" the use of electronic detonators to initiate the perimeter holes in an underground tunnel blasting operation.

SUMMARY OF THE INVENTION

Generally, in accordance with the present invention, significant improvements in efficiency of tunnel roadway and underground blasting are attained by a blasting system in which detonators having electronic delay mechanisms ("electronic delay detonators") and detonators having pyrotechnic delay mechanisms ("pyrotechnic delay detonators") are all initiated by non-electric fuses, for example, shock tube. This arrangement avoids the necessity of providing an electric wiring harness to initiate the electronic delay detonators and a separate non-electric trunkline, for example, low energy detonating cord, to initiate the pyrotechnic delay detonators. Thus, a plurality of both electronic and pyrotechnic delay detonators are equipped with, for example, shock tube fuses which are initiated by an ignition signal transmitted to the shock tube fuses by detonating cord or other suitable non-electric trunklines.

Specifically, in accordance with the present invention there is provided a system for blasting a geological formation to form therein a tunnel having a perimeter wall enclosing an interior space, the system comprising the following components. A series of perimeter boreholes is disposed in such geological formation in a pattern corresponding to such perimeter wall, with explosive charges disposed in respective ones of the perimeter boreholes. A series of interior boreholes is disposed in such geological formation interiorly of the perimeter boreholes, with explosive charges disposed in respective ones of the interior boreholes. Electronic delay perimeter detonators having shock tube fuses are disposed in respective ones of the perimeter boreholes in signal-transfer communication with the explosive charges contained in the associated perimeter boreholes, and pyrotechnic delay interior detonators having shock tube fuses are disposed in respective ones of the interior boreholes in signal-transfer communication with the explosive charges contained in the associated interior boreholes. The fuses of both the perimeter detonators and the interior detonators being connected in signal-transfer communication with a non-electric trunkline, whereby to initiate both the perimeter detonators and the interior detonators by an initiation signal transmitted via the trunkline.

Another aspect of the present invention includes that the trunkline comprises a single non-electric trunkline to which the fuses of the electronic delay detonators and the pyrotechnic delay detonators are connected. Another aspect provides for the non-electric trunkline to comprise detonating cord.

Yet another aspect of the present invention provides a method for blasting a geological formation to form therein a tunnel having a perimeter wall enclosing an interior space, the method comprising the following steps. Drilling a series of perimeter boreholes into the geological formation in a pattern corresponding to such perimeter wall; and placing explosive charges in respective ones of the perimeter boreholes. Drilling a series of interior boreholes into the geological formation interiorly of the perimeter boreholes; and placing explosive charges disposed in respective ones of the interior boreholes. Emplacing electronic delay perimeter detonators having shock tube fuses into respective ones of the perimeter boreholes in signal-transfer communication with the explosive charges contained in the respective perimeter boreholes; and emplacing pyrotechnic delay interior detonators having shock tube fuses into respective ones of the interior boreholes in signal-transfer communication with the explosive charges contained in the respective interior boreholes. Connecting the fuses of both the perimeter detonators and the interior detonators in signal-transfer communication with a non-electric trunkline; and initiating both the perimeter detonators and the interior detonators by sending an initiation signal via the trunkline to the detonator fuses.

Another method aspect of the present invention includes connecting the fuses of the perimeter detonators and the interior detonators to the same single, non-electric trunkline.

Yet another method aspect includes utilizing detonating cord as non-electric trunkline.

As used herein and in the claims, the term "shock tube" refers to non-electric signal transmission tubing comprising tubing, usually a synthetic polymer tubing, the interior wall of which is coated with a reactive mixture such as fine aluminum powder and a pulverulent high explosive such as pentaerythritol tetranitrate ("PETN").

DETAILED DESCRIPTION OF THE INVENTION AND SPECIFIC EMBODIMENTS THEREOF

Figure 1:
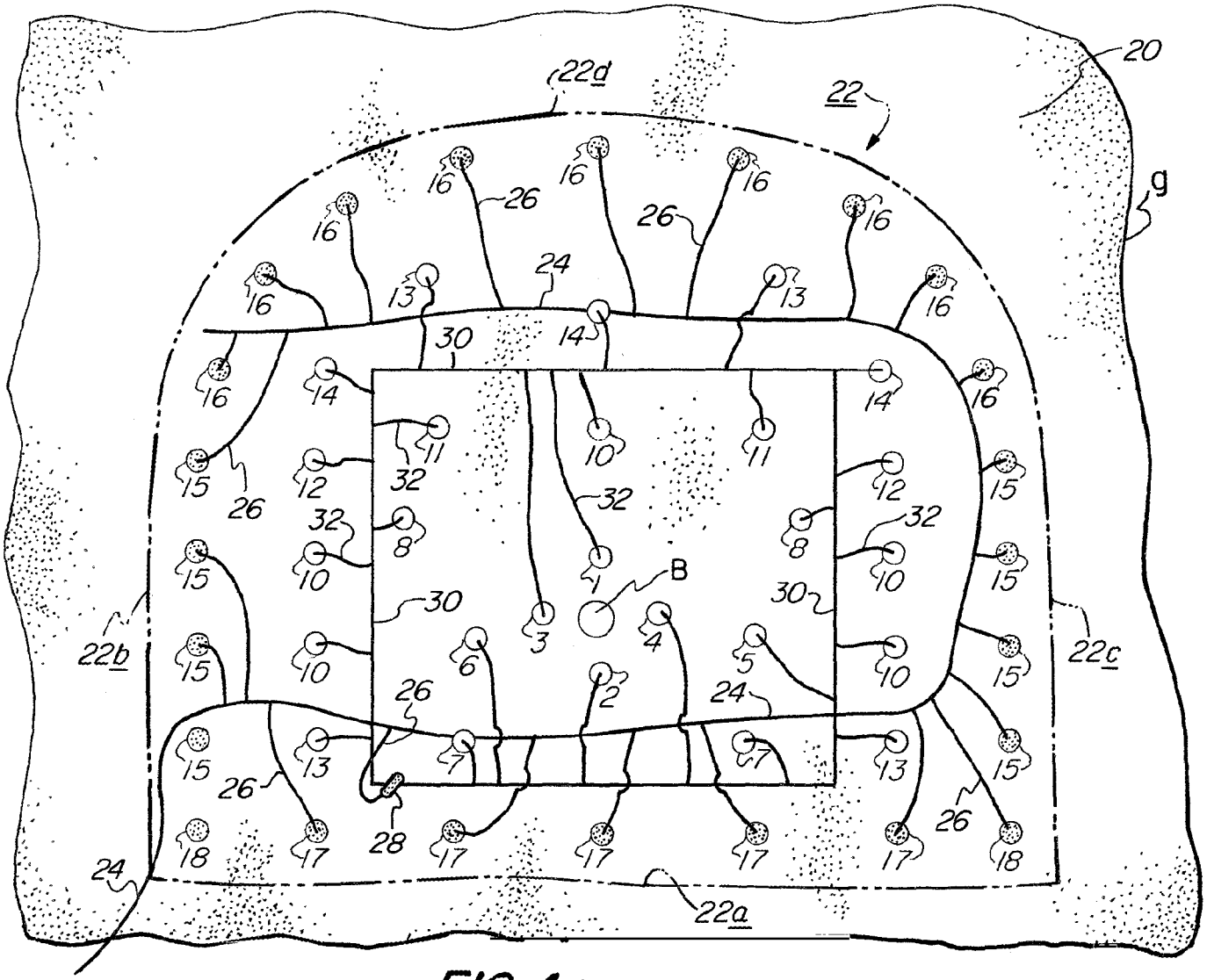
FIG. 1 (PRIOR ART)
FIG. 1 is a schematic elevation view showing a blasting system in accordance with the prior art for tunneling into a face.

While efficient blasting operation is of course always important, in the case of underground mining operations it is especially critical during periods of relatively low prices for the ore, coal or mineral being mined. Whether in tunnel roadway construction or under-ground mining, efficient tunnel blasting operations depend in part on the quality of the perimeter profile of the tunnel (cavity) created by the explosion. That is, the perimeter of the cavity left by blasting the geological formation should not be excessively fractured or weakened, but desirably should be a "clean" void profile, one without excessive cracking or irregularities along the walls of the tunnel to be created by the blast. Other factors impacting efficiency include control of blast fragmentation to provide a desirable range of sizes in the muck pile resulting from the blast, and reduction of the cycle time between successive blasts. The cycle time includes the time required to set up each blast, including connecting fuses to the detonators to be emplaced within the boreholes, as well as removing the muck pile generated in an earlier blast, drilling and loading new boreholes, etc.

As is well known in the art, electronic delay detonators (sometimes herein referred to simply as "electronic detonators") provide much more accurate timing of initiation of the detonator than do pyrotechnic delay detonators (sometimes herein referred to simply as "pyrotechnic detonators"). Timing of explosions between different boreholes is desirably controlled within milliseconds of each other over a range of pre-selected delay periods. For example, it may be desired to have a 25 millisecond delay between detonations in certain boreholes, a 60 millisecond delay between detonations in other boreholes and, in some circumstances, a 1,500 millisecond, i.e., 1.5 seconds, delay between detonations in other boreholes. The range of deviation from the target detonation times of a series of detonators is referred to as the "scatter range". Testing of long delay time pyrotechnic detonators such as LP16 pyrotechnic detonators revealed a scatter range of ±150 milliseconds. In contrast, testing of comparable detonators, such as a SmartShot™ electronic LP16 detonator manufactured by DetNet South Africa Pty Ltd., demonstrated a scatter range of only ±1 millisecond.

In blasting a geological formation, detonators are respectively disposed in explosive charges contained in respective perimeter and interior boreholes drilled into the geological formation, for example, into a rock or ore formation, coal seam or the like. It is known to utilize electronic delay detonators disposed in the explosive charges contained in the perimeter boreholes and to use pyrotechnic delay detonators disposed in the explosive charges contained in the interior boreholes. The use of pyrotechnic delay detonators in the interior boreholes reduces the overall cost of the detonators without adversely affecting the formation of a clean, i.e., regular, profile of the cavity generated by the blast.

Reducing to the extent possible the scatter range in the perimeter boreholes will minimize or at least reduce back breakage and overbreak and preserve the contour of the design profile of the cavity created by the blast (the "blast cavity"). The advantage provided by the orders of magnitude improvement in scatter range of electronic delay detonators as compared to the scatter range of pyrotechnic delay detonators is especially pronounced when poor ground conditions are encountered.

A typical environment of use of an embodiment of the present invention is disclosed in the John Kovacs article "*Mine Development Optimisation—An Evolutionary Process*" published in connection with the 12$^{th}$ AUSIMM Underground Operator's Conference, Adelaide South Australia, Australia, 24-26 Mar. 2014. The entirety of this article is incorporated by reference herein and made part of this application. The author, John Kovacs, is a Senior Technical Consultant of DynoConsult, a company related to the assignee of this application, and authored the article based in part on information supplied to him by the inventor.

In conducting blasting operations to form tunnels in mining operations and the like, it is desired that the resulting blast cavity have no or reduced back breakage and no or reduced overbreak while avoiding or minimizing underbreak. Underbreak is the failure to attain the desired diameter of the blast cavity in parts of the cavity and is problematic as it may require a second operation to remove unwanted rock protruding into the blast cavity. (As used herein, the term "rock" has its broadest meaning as comprising a geological formation which may be rock, an ore body, a coal seam, etc.) Overbreak is the unwanted removal of rock beyond the planned diameter of the blast cavity in parts of the cavity and is problematic as it often requires reconstitution of the planned diameter with concrete or the like. Obviously, the occurrence of overbreak or underbreak is a serious problem as it slows production and requires additional work to rectify the situation. Back breakage is cracking of the rock adjacent to the perimeter of the blast cavity and is also problematic as it weakens the structure around the blast cavity. Reducing back breakage by largely confining the effect of the blast to the desired profile of the resulting blast cavity reduces the amount of ground support structure which may be required to reinforce the geological formation surrounding the blast cavity. Ground support structure includes installation of timber or steel support columns, or designing the blast to leave behind support columns of the rock being blasted. Avoiding the need to supply ground structure, as well as the attainment of more closely controlled size range of the rock in the muck pile, are advantages of using electronic detonators in the perimeter boreholes.

The use of pyrotechnic delay detonators in the interior boreholes provides a significant cost savings as compared to using electronic detonators throughout. However, the use of both electronic and pyrotechnic detonators in the same blast set-up complicates the fuse system because the prior art systems required that the electronic detonators be shot with electric wire fuses and the pyrotechnic detonators be shot with shock tube fuses. The resulting hybrid wire/shock tube fuse system complicates installation, requires more extensive training of personnel and increases the chances of error during se-up of the blast.

Figure 2:
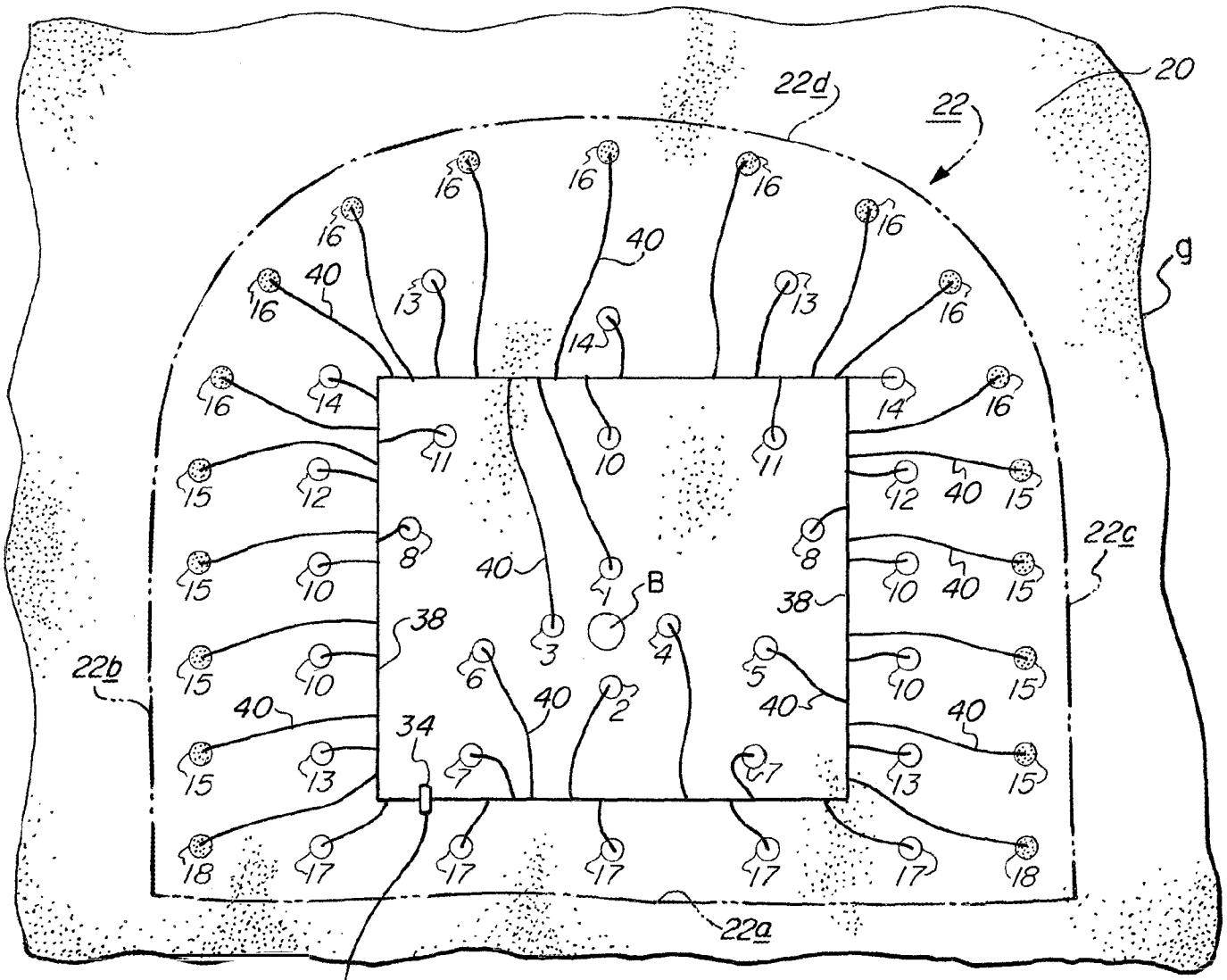
FIG. 2 is a schematic elevation view showing a blasting system in accordance with an embodiment of the present invention for tunneling into the same face illustrated in FIG. 1.

FIG. 1 schematically shows a prior art blasting system installed through face 20 of a geological formation g in which a tunnel 22 (which may, but need not, be a substantially horizontal tunnel) is to be blasted. Face 20 may be, for example, an underground mine face. Tunnel 22 may be a prospective tunnel or it may be an extension of an already existing tunnel. In any case, the blast cavity resulting from the blast will define a tunnel 22 having a nearly flat floor 22*a*, opposite sidewalls 22*b*, 22*c* and a concave arched roof 22*d*. The boreholes of FIGS. 1 and 2 are numbered to correspond to the delay Period Number of the detonators emplaced in the boreholes. The following Table shows the delay period in milliseconds ("ms") for various delay detonators.

TABLE

| Period No. | Delay Time (ms) |
|---|---|
| 1 | 500 |
| 2 | 800 |
| 3 | 1100 |
| 4 | 1400 |
| 5 | 1700 |
| 6 | 2000 |
| 7 | 2300 |
| 8 | 2700 |
| 9 | 3100 |
| 10 | 3500 |
| 11 | 3900 |
| 12 | 4400 |
| 13 | 4900 |
| 14 | 5400 |
| 15 | 5900 |
| 16 | 6500 |
| 17 | 7200 |
| 18 | 8000 |

A plurality of perimeter boreholes 15, 16, 17 and 18 have respective electronic delay detonators disposed therein. The delay periods of the detonators respectively disposed in the perimeter boreholes 15, 16, 17 and 18 are, as shown (in milliseconds) in the above Table, 5.9, 6.5, 7.2 and 8.0 seconds. The perimeter boreholes 15, 16, 17 and 18 are positioned to approximately define the desired profile of tunnel 22. The perimeter boreholes (and the interior boreholes as well) are substantially parallel to the longitudinal axis of the blast cavity, i.e., the tunnel 22, and so are substantially horizontal in a horizontal tunnel. As is conventional, face 20 has drilled into it a burn/cut hole B to provide, as is well known, a point of relief, that is, to provide room for shifting of rock during the initial stage of detonation.

A plurality of interior boreholes 1-8 and 10-14 are numbered to correspond to the delay Period Numbers of the detonators disposed in the interior boreholes. Thus, the delay periods of the detonators disposed in the interior boreholes vary, as shown (in milliseconds) in the above Table, from 0.5 seconds (Period No. 1) to 5.4 seconds (Period No. 14). The interior boreholes are positioned within the perimeter defined by the perimeter boreholes. The selected delay periods of detonators emplaced in the boreholes as described above is of course specific to a given case. Obviously, different delay periods and combinations of delay periods may be selected depending on the nature of the geological formation being blasted to form a tunnel of prescribed dimensions.

Each of the perimeter boreholes contains an explosive charge having embedded within it one or more electronic delay detonators whereas each of the interior boreholes contains an explosive charge and one or more pyrotechnic delay detonators. A harness wire 24 is connected via electric fuse wires 26 to electronic detonators respectively disposed within the perimeter boreholes. A relay electronic detonator 28 is connected via one of the electric fuse wires 26 to harness wire 24 and is detonated in order to initiate the detonating cord trunkline 30 which itself is connected by a plurality of shock tube fuses 32 to respective pyrotechnic delay detonators embedded within the explosive charges respectively disposed within the interior boreholes. In order to initiate the blasting sequence, a firing signal from an electric blasting generator (not shown) sends an appropriate electric current through harness wire 24 thence via electric fuse wires 26 to the electronic detonators respectively disposed in each of the perimeter boreholes and to relay detonator 28. Initiation of relay detonator 28 initiates detonating cord trunkline 30 which in turn initiates each of shock tube fuses 32 to initiate the pyrotechnic detonators respectively disposed in the interior boreholes.

The prior art scheme illustrated in FIG. 1 is seen to require two separate firing systems respectively comprising electric harness wire 24 and detonating cord trunkline 30, as well as the extension of electric harness wire 24 to fire a relay electronic delay detonator 28. The latter must be connected in signal transmission relationship to detonating cord trunkline 30. Setting up this complex wiring scheme is time-consuming, requires maintaining in stock electric wire for electric harness wire 24 and detonating cord for detonating cord trunkline 30, electronic detonators having electric fuse wires 26 and pyrotechnic detonators having shock tube fuses 32. In addition, the relatively complex nature of the arrangement requires well trained personnel and is nonetheless more susceptible to connection errors, and therefore failures, than is the simplified and improved system of the present invention, an embodiment of which is described below in connection with FIG. 2.

FIG. 2 schematically shows the same face 20 of geological formation g illustrated in FIG. 1, and so the description of structures identically numbered to those of FIG. 1 is not repeated. The face 20 of FIG. 2 is drilled identically as in FIG. 1, with interior boreholes 1-8 and 10-14, perimeter boreholes 15, 16, 17 and 18, and burn/cut hole B. As is the case in the prior art arrangement of FIG. 1, the perimeter boreholes 15-18 are respectively loaded with explosive charges within which are embedded electronic delay detonators, and the interior boreholes similarly have therein explosive charges within which are embedded one or more pyrotechnic delay detonators. However, the embodiment of the present invention illustrated in FIG. 2 differs from the prior art arrangement of FIG. 1 in that the electronic delay detonators have shock tube fuses 40 instead of electric wire fuses. Electronic delay detonators suitable for use in the present invention and having shock tube fuses are sold under the trademark DigiDet by DetNet South Africa (Pty) Ltd. A signal-transmitting detonator 34 has a fuse 34*a* connected to a signal-initiating device (not shown). Fuse 34*a* may be a shock tube fuse. Signal-transmitting detonator 34 is connected in signal-transmitting relationship with a detonating cord trunkline 38 which is connected by shock tube fuses 40 both to electronic delay detonators in the perimeter boreholes, as well as to pyrotechnic delay detonators in the interior boreholes. The electronic delay detonators are embedded in respective explosive charges disposed in respective ones of the perimeter boreholes as exemplified by FIG. 2A, and the pyrotechnic delay detonators are embedded in respective explosive charges disposed in respective ones of the interior boreholes as ex-emplified in FIG. 2B. Initiation of detonating cord trunkline 38 by signal-transmitting detonator 34 initiates all shock tube fuses 40 to initiate the detonators contained in both the perimeter and interior boreholes.

Figure 2A:
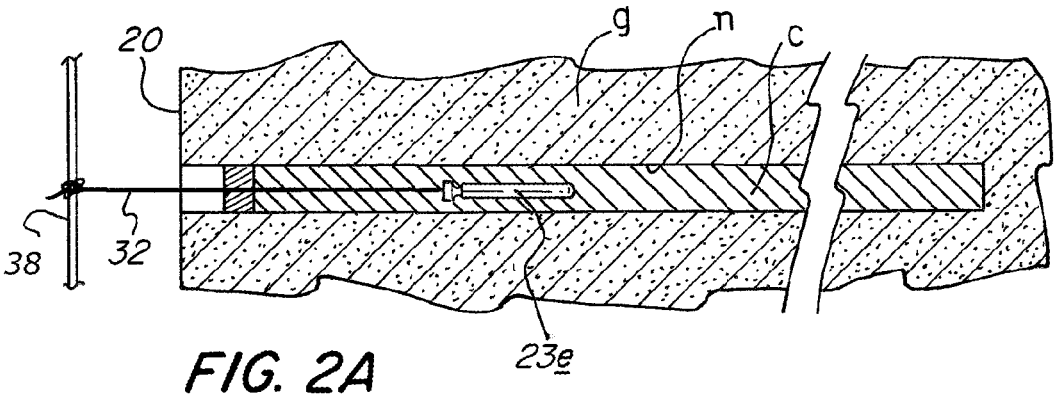
FIG. 2A is a schematic cross-sectional view, with part broken away, taken parallel to a typical perimeter borehole of FIG. 2.

FIG. 2A shows a typical perimeter borehole n formed in geological formation g and containing an explosive charge c within which is embedded an electronic delay detonator 23*e* from which extends a shock tube fuse 32. Shock tube fuse 32 exits from perimeter borehole n at face 20 and is connected to detonating cord trunkline 38.

Figure 2B:
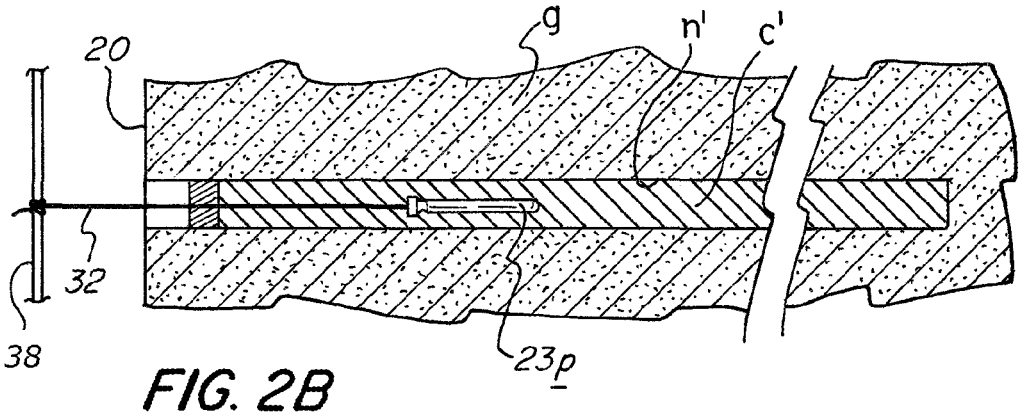
FIG. 2B is a view identical to that of FIG. 2A except that it is taken parallel to a typical interior borehole of FIG. 2.

FIG. 2B shows a typical interior borehole n' which is substantially identical to the perimeter borehole of FIG. 2A except that a pyrotechnic delay detonator 23*p* is utilized. Pyrotechnic delay detonator 23*p* is embedded within an explosive charge c' and its shock tube fuse 32 exits from interior borehole n' at face 20 and is connected to detonating cord trunkline 38.

The blasting system of FIG. 2 is seen to be greatly simplified relative to the prior art system illustrated in FIG. 1. Instead of having to wire both electrical and detonating cord systems, only a single detonating cord trunkline is required. This reduces the items which must be kept in stock and greatly simplifies the set-up procedure, thereby both lessening training requirements and greatly reducing the prospects for error. Set-up time is also reduced.

When utilizing electronic delay detonators in the perimeter boreholes, control of the perimeter of the void created by the blast was so precise that "half-barrel" markings were noticeable in the walls of the resulting blast cavity. These markings are the longitudinal half of perimeter boreholes and their presence at the edge of the void created by the blast shows how accurately the void perimeter was formed. This accuracy was attained despite the use of pyrotechnic delay detonators in the interior boreholes.

While the invention has been described in detail with reference to a specific embodiment, it will be appreciated that numerous variations may be made to the described embodiment, which variations nonetheless lie within the scope of the present invention.

What is claimed is:

1. A system for blasting a geological formation to form therein a tunnel having a perimeter wall enclosing an interior space, the system comprising:

a series of perimeter boreholes disposed in such geological formation in a pattern corresponding to such perimeter wall, with explosive charges disposed in respective ones of the perimeter boreholes;

a series of interior boreholes disposed in such geological formation interiorly of the perimeter boreholes, with explosive charges disposed in respective ones of the interior boreholes;

electronic delay perimeter detonators having shock tube fuses are disposed only in respective ones of the perimeter boreholes in signal-transfer communication with the explosive charges contained in the associated perimeter boreholes, and pyrotechnic delay interior detonators having shock tube fuses are disposed only in respective ones of the interior boreholes in signal-transfer communication with the explosive charges contained in the associated interior boreholes;

the fuses of both the perimeter detonators and the interior detonators being connected in signal-transfer communication with a non-electric trunkline, whereby to initiate both the perimeter detonators and the interior detonators by an initiation signal transmitted via the trunkline.

2. The system of claim 1 comprising a single non-electric trunkline to which the fuses of the electronic delay detonators and the pyrotechnic delay detonators are connected.

3. The system of claim 2 wherein the non-electric trunkline comprises detonating cord.

4. The system of claim 1 wherein the non-electric trunkline comprises detonating cord.

5. A method for blasting a geological formation to form therein a tunnel having a perimeter wall enclosing an interior space, the method comprising the following steps:

drilling a series of perimeter boreholes into the geological formation in a pattern corresponding to such perimeter wall;

placing explosive charges in respective ones of the perimeter boreholes;

drilling a series of interior boreholes into the geological formation interiorly of the perimeter boreholes;

placing explosive charges in respective ones of the interior boreholes;

emplacing electronic delay perimeter detonators having shock tube fuses only into respective ones of the perimeter boreholes in signal-transfer communication with the explosive charges contained in the respective perimeter boreholes;

emplacing pyrotechnic delay interior detonators having shock tube fuses only into respective ones of the interior boreholes in signal-transfer communication with the explosive charges contained in the respective interior boreholes;

connecting the fuses of both the perimeter detonators and the interior detonators in signal-transfer communication with a non-electric trunkline; and initiating both the perimeter detonators and the interior detonators by sending an initiation signal via the trunkline to the detonator fuses.

6. The method of claim 5 further comprising connecting the fuses of the perimeter detonators and the interior detonators to the same single, non-electric trunkline.

7. The method of claim 6 comprising utilizing detonating cord as the non-electric trunkline.

8. The method of claim 5 comprising utilizing detonating cord as the non-electric trunkline.

* * * * *